US006029860A

United States Patent [19]

Donselman et al.

[11] Patent Number: 6,029,860

[45] Date of Patent: Feb. 29, 2000

[54] LIQUID DISPENSING DEVICE AND HYGIENIC ADAPTER

[75] Inventors: Edward H. Donselman; Lowell C. Burnham; Scott E. Sloan, all of Freeport, Ill.; Steve Suchanek, Madison, Wis.

[73] Assignee: Elkay Manufacturing Company, Oak Brook, Ill.

[21] Appl. No.: 08/756,064

[22] Filed: Nov. 25, 1996

Related U.S. Application Data

[63] Continuation of application No. 08/472,118, Jun. 7, 1995, Pat. No. 5,577,393, which is a continuation-in-part of application No. 08/139,414, Oct. 20, 1993, Pat. No. 5,493,873.

[51] Int. Cl.[7] ..... B67D 5/06

[52] U.S. Cl. ..... 222/185.1; 141/363; 141/366; 222/485.1

[58] Field of Search ..... 222/83, 185.1, 222/481.5; 141/363, 364, 365, 366

[56] References Cited

U.S. PATENT DOCUMENTS

| | | |
|---|---|---|
| Re. 12,352 | 5/1905 | Cole . |
| Re. 32,354 | 2/1987 | Savage . |
| 497,896 | 5/1893 | Ruppel . |
| 738,712 | 9/1903 | Cole . |
| 996,127 | 6/1911 | Patnaude . |
| 1,009,437 | 11/1911 | Parnaude . |
| 1,018,924 | 2/1912 | Patnaude . |
| 1,142,210 | 6/1915 | Wagner . |
| 1,228,836 | 6/1917 | Schulse . |
| 1,241,352 | 9/1917 | Doering . |
| 1,248,705 | 12/1917 | Pogue . |
| 1,319,376 | 10/1919 | Cooper . |
| 1,325,427 | 12/1919 | Weaver . |
| 1,337,206 | 4/1920 | Doering et al. . |
| 1,933,192 | 10/1933 | Taylor . |
| 1,940,932 | 12/1933 | Albertine . |
| 1,976,007 | 10/1934 | Cullen et al. . |
| 2,057,238 | 10/1936 | Krug . |

(List continued on next page.)

FOREIGN PATENT DOCUMENTS

| | | |
|---|---|---|
| 631376 | 11/1961 | Canada . |
| WO90/03919 | 4/1990 | WIPO . |

*Primary Examiner*—William E. Tapolcai
*Attorney, Agent, or Firm*—Leydig, Voit &Mayer, Ltd.

[57] ABSTRACT

A liquid dispensing device and a hygenic adapter are provided wherein the dispensing device includes a cabinet housing a liquid reservoir open at its upper end and defining a generally annular ring portion for supporting the shoulder portion of an inverted bottle over the reservoir and the adapter includes a feed tube formed integrally with and supported by the cup-shaped structure having an inwardly stepped side wall including a peripheral flange portion adapted to be supported by the open upper end of the reservoir and an annular gasket carried by and surrounding the cup-shaped structure for sealingly closing the open upper end of the reservoir.

6 Claims, 8 Drawing Sheets

U.S. PATENT DOCUMENTS

| | | | |
|---|---|---|---|
| 2,072,629 | 3/1937 | Fernholz . | |
| 2,108,898 | 2/1938 | Lyons . | |
| 2,689,669 | 9/1954 | Ericson | 222/185.1 |
| 2,767,960 | 10/1956 | Fast . | |
| 2,811,272 | 10/1957 | Lawlor . | |
| 2,858,052 | 10/1958 | Cosakos | 222/185.1 |
| 2,912,142 | 11/1959 | Schultz . | |
| 3,088,289 | 5/1963 | Alex . | |
| 3,224,609 | 12/1965 | Dietert | 222/83 |
| 3,892,235 | 7/1975 | Van Amerongen . | |
| 3,893,599 | 7/1975 | Birell . | |
| 3,955,682 | 5/1976 | Baren . | |
| 3,966,093 | 6/1976 | Frahm et al. . | |
| 3,974,863 | 8/1976 | Frahm et al. . | |
| 4,239,130 | 12/1980 | Altadonna . | |
| 4,267,945 | 5/1981 | Maynard, Jr. . | |
| 4,320,861 | 3/1982 | Rieke et al. . | |
| 4,356,848 | 11/1982 | Spies . | |
| 4,391,308 | 7/1983 | Steiner . | |
| 4,421,146 | 12/1983 | Bond et al. . | |
| 4,436,125 | 3/1984 | Blenkush . | |
| 4,444,340 | 4/1984 | Bond et al. . | |
| 4,445,551 | 5/1984 | Bond et al. . | |
| 4,484,599 | 11/1984 | Hanover et al. . | |
| 4,523,698 | 6/1985 | Kienlein et al. . | |
| 4,535,604 | 8/1985 | Cavalli . | |
| 4,538,427 | 9/1985 | Cavalli . | |
| 4,573,329 | 3/1986 | Cavalli . | |
| 4,597,423 | 7/1986 | Chenot . | |
| 4,597,509 | 7/1986 | Pereira . | |
| 4,629,096 | 12/1986 | Schroer et al. . | |
| 4,697,785 | 10/1987 | Tuseth . | |
| 4,699,188 | 10/1987 | Baker et al. . | |
| 4,711,380 | 12/1987 | Ulm . | |
| 4,717,051 | 1/1988 | Leclerc . | |
| 4,779,426 | 10/1988 | Desrosiers . | |
| 4,793,514 | 12/1988 | Sheets . | |
| 4,805,808 | 2/1989 | Larson . | |
| 4,821,875 | 4/1989 | Groves et al. . | |
| 4,834,267 | 5/1989 | Schroer et al. . | |
| 4,846,236 | 7/1989 | Deruntz . | |
| 4,874,023 | 10/1989 | Ulm . | |
| 4,902,320 | 2/1990 | Schroer et al. . | |
| 4,903,865 | 2/1990 | Janowitz . | |
| 4,972,976 | 11/1990 | Romero | 222/185.1 |
| 4,991,635 | 2/1991 | Ulm . | |
| 5,031,676 | 7/1991 | Ulm . | |
| 5,105,992 | 4/1992 | Fender et al. . | |
| 5,121,778 | 6/1992 | Baker et al. | 222/185.1 |
| 5,213,309 | 5/1993 | Makishima . | |
| 5,222,530 | 6/1993 | Baker et al. . | |
| 5,222,531 | 6/1993 | Baker et al. . | |
| 5,232,125 | 8/1993 | Adams . | |
| 5,273,083 | 12/1993 | Burrows . | |
| 5,284,188 | 2/1994 | Baker et al. . | |
| 5,289,854 | 3/1994 | Baker et al. . | |
| 5,289,855 | 3/1994 | Baker et al. . | |
| 5,295,518 | 3/1994 | Baker et al. . | |
| 5,295,519 | 3/1994 | Baker et al. . | |
| 5,337,922 | 8/1994 | Salkeld et al. . | |
| 5,368,197 | 11/1994 | Sutera | 222/185.1 |
| 5,370,270 | 12/1994 | Adams . | |
| 5,392,939 | 2/1995 | Hidding et al. . | |
| 5,413,152 | 5/1995 | Burrows . | |
| 5,431,205 | 7/1995 | Gebhard . | |
| 5,464,127 | 11/1995 | Burrows . | |
| 5,526,961 | 6/1996 | Burrows . | |
| 5,533,647 | 7/1996 | Long-Hsiung | 222/83 |
| 5,542,555 | 8/1996 | Hidding et al. . | |
| 5,653,270 | 8/1997 | Burrows . | |

LIQUID DISPENSING DEVICE AND HYGIENIC ADAPTER

This application is a continuation of prior-filed application Ser. No. 08/472,118, for "Liquid Dispensing Device", filed Jun. 7, 1995, now U.S. Pat. No. 5,577,393, which in turn is a continuation-in-part of prior-filed application Ser. No. 08/139,414, for "Liquid Dispensing Device", filed Oct. 20, 1993, now U.S. Pat. No. 5,493,873, both applications being assigned to the same assignee as the present application and hereby incorporated herein by reference.

FIELD OF THE INVENTION

The invention relates generally to beverage dispensers, such as refrigerated water or beverage coolers. More particularly, the present invention is directed to liquid dispensers which include components which may be easily removed from the housing of the cooler and/or disassembled for easy cleaning, replacement, or repair.

BACKGROUND OF THE INVENTION

Bottle-type water coolers generally include an upright cabinet or housing containing a refrigeration unit and a liquid container which receives the mouth and neck portion of a inverted water bottle. Water flows from the bottle until the water level closes the bottle neck. Typically a refrigeration system cools the reservoir and the water being held there. Some systems are provided with an additional tank, supplied with water from the reservoir, and have a heating system which provides hot water. Water is dispensed by draining the reservoir, usually through a faucet. When the water level falls below the inverted bottle neck, air in the reservoir can enter the bottle, bubble to the top, and release more water to maintain the water level in the reservoir.

Inherent in the design of many of the water coolers or beverage dispensers currently in use are problems associated with sterility or cleanliness. Such problems may result from the materials from which the components which comprise the water flow path are formed. Thus, the potential for oxidation or general deterioration of the materials, particularly rust formation, tends to reduce the usefulness of such apparatus. Additionally, depending upon the location and environment of the dispenser, the type of water or other beverage used in the dispenser, the rate at which the water or other beverage is used, and the care taken to prevent introduction of foreign matter when a water bottle is replaced, particulate and other types of contaminants may be introduced to the liquid container and may be ultimately dispensed through normal operation. To maintain cleanliness, the components comprising the water flow path of conventional bottle-type water coolers require periodic cleaning to remove sediment or other contaminants, such as dirty film. The frequency of cleaning required for such water coolers generally depends, at least in part, on the above enumerated conditions.

Some of the difficulties related to maintaining a desirable level of cleanliness in such units are caused by the inaccessibility of the components which comprise the water flow path. Thus, many of the liquid containers are so constructed that it is difficult or impossible to clean all of the internal surfaces with these components in the housing. To remove these components from the housing also proves difficult with most of the water coolers currently being used. Disassembly or removal in most of the water coolers of this type typically requires either large expenditures of time, the use of tools and in some instances special tools, or the possible destruction of components of the water cooler, particularly seals, in the disassembly procedure, or a combination of the foregoing. The removal procedure and the attendant difficulties associated therewith tend to discourage the periodic maintenance required for cleanliness of such water or beverage dispensing systems.

OBJECTS OF THE INVENTION

It is a primary object of the invention to provide a liquid dispenser that is highly serviceable, and a more specific object of the invention is to provide a dispenser that may be easily assembled and disassembled without the use of tools.

It is a further object of the invention to provide a dispenser wherein the components comprising the water flow path may be completely removed from the housing for replacement or cleaning. A related object is to provide a dispenser in which the components comprising the water flow path are internally cleanable.

Another object of the invention is to provide a dispenser which is durable, even at high temperatures, the components of the dispenser exhibiting high thermal stability and being resistant to UV degradation.

An additional object of the invention is to provide a unit that is safe, even for home use, and meets all applicable governmental safety regulations.

Yet another object of the invention is to provide a unit that may be easily and economically manufactured and assembled.

BRIEF SUMMARY OF THE INVENTION

In accordance with the present invention, a liquid dispenser is provided including a cabinet housing a liquid reservoir open at its upper end and readily releasable from engagement with the evaporator coil of a refrigeration unit for removal from the cabinet. The reservoir is surrounded by insulation which may be removed in sections. The dispenser also includes a removable waterway and valve assembly with inlet couplings press-fit to the reservoir outlets and to the inlets and outlets of a hot tank removably suspended below the valve assembly and liquid reservoir. The removable waterway and valve assembly is preferably made in two "halves" suitably held together by removable connections such as bolts or screws so that the assembly may be readily disassembled for inspection and cleaning. The hot tank may be pivoted down and shifted away from the valve assembly to facilitate removal of the latter. The valve operating lever for the hot water discharge is provided with a safety interlock catch to prevent inadvertent discharge of hot water from the valved faucet. The hot tank drain is also provided with a recessed cam-operated compression valve to facilitate authorized draining of the hot tank with a suitable cam engaging tool but to preclude inadvertent draining of the hot tank by a child. The dispenser may be used as a conventional inverted bottled water cooler or fitted with an adapter including a dispensing feed tube for opening and closing special no-spill type bottle caps.

These and other features and advantages of the invention will be more readily apparent upon reading the following description of a preferred exemplified embodiment of the invention and upon reference to the accompanying drawings wherein:

Figure 1:
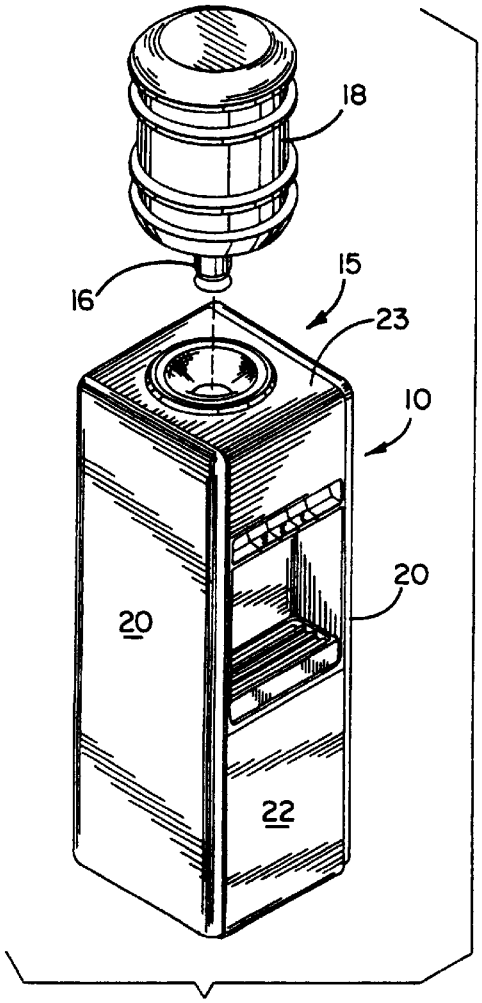
FIG. 1 is an isometric view of a liquid dispensing system cabinet of the present invention, with an inverted liquid container shown located above the dispenser rather than in a lower supported position to discharge its contents into the dispensing system housed within the cabinet.

While the invention will be described in connection with certain preferred embodiments, there is no intent to limit it to those embodiments. On the contrary, the intent is to cover all alternatives, modifications, and equivalents included within the spirit and scope of the invention as defined by the appended claims.

DESCRIPTION OF THE PREFERRED EMBODIMENT

Turning now to the drawings, there is shown a liquid dispensing system (shown generally as 10) including a cabinet (shown generally as 15) of the type having an open-topped primary cooling reservoir which is disposed to receive water from the inverted neck 16 of a bottle 18 containing drinking water or other potable liquid. In keeping with an aspect of the present invention, the cabinet has readily removable side and front panel components (20 and 22, respectively) and can be fitted with a top panel 23 which can also be readily removed, independent of the side panels, and changed to suit various dispensing applications. Typically, the reservoir and its contents are subject to temperature control by a refrigeration system and/or a heating system which, as described in greater detail below, is contained in the lower portion of the cabinet 15. Hot, cold and ambient temperature water may be obtained from the dispenser faucets by depressing the appropriate one of a plurality of valve operating levers projecting outwardly from the front panel 22 of the cabinet. In the illustrated cooler, the front panel has a recessed portion within which the faucet levers are mounted so as to set the faucets back into the cabinet and thus prevent inadvertent contact.

Figure 2:
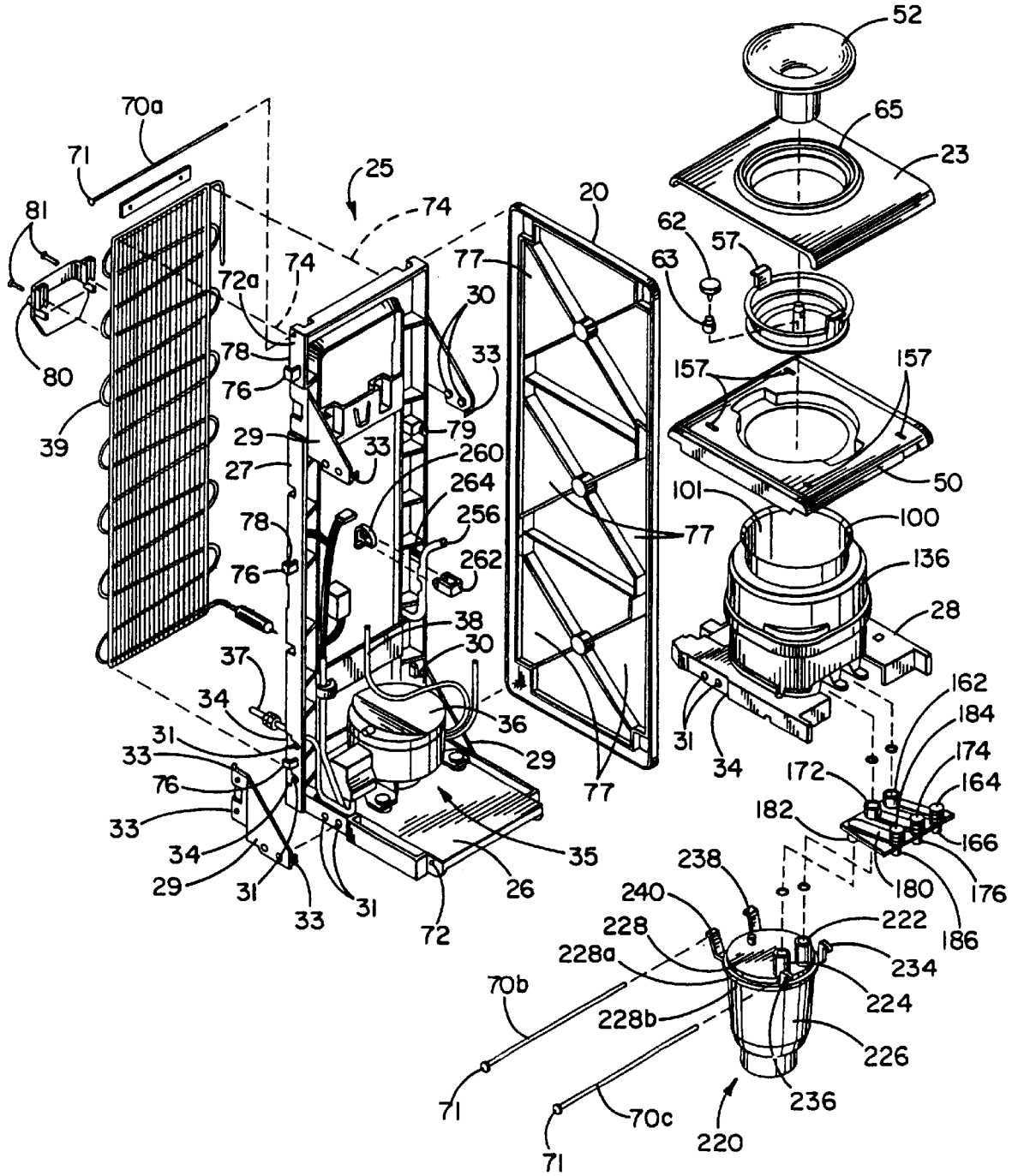
FIG. 2 is an exploded isometric view of the dispensing system of this invention, showing the frame assembly, side and top panels and the principal internal dispensing system components.

In keeping with the invention, and as best shown in FIG. 2, the cabinet 15 is comprised of a supporting frame assembly (shown generally as 25), which as illustrated is made up of a baseplate 26, an upstanding frame component 27, and a shelf 28. The baseplate and shelf are each connected and secured in cantilever fashion to the upstanding frame component by dovetailed connections and are reinforced by side-mounted gusset plates 29 that serve to interconnect and align the baseplate and shelf with respect to the upstanding frame component. The gusset plates 29 also serve to strengthen the joint between the baseplate and the shelf on the one hand and the upstanding frame component on the other, and to this end, a plurality of projections or bosses 30 are provided on the interior surface of each gusset plate and are received in openings 31 on the sides of the baseplate 26 and shelf components 28 such that forces can be effectively transmitted therebetween. The gusset plates 29 are also preferably provided with three additional tab projections 33 which are snap-fit into openings 34 in the baseplate 26, shelf 28 and frame 27, and which serve to hold the gusset plates to the frame components with the bosses 30 engaged in the openings 31. The baseplate 26 and shelf 28 are designed to be readily demountable from the frame 27 and further details thereof, including the interfitting dovetailed connections are disclosed in copending application Ser. No. 08/139,469, filed Oct. 20, 1993 for "Cabinet and Supporting Frame for Liquid Dispensing System" which is hereby incorporated herein by reference.

As illustrated in FIG. 2, the preferred dispensing system of the present invention includes a refrigeration system, designated generally as 35, comprising conventional components such as a compressor, condenser and evaporator coils. A thermostat, relay and electrical cables (designated generally as TC) are located, preferably, within a lower portion of the cabinet. The compressor 36 is powered by electricity received through a cord 37 from an external electric power outlet (not shown). The compressor compresses and circulates a refrigerant, such as HCFC 134*a*, through a line 38 to a condenser unit 39, which is attached by suitable connectors such as screws to the rear of the upstanding frame component 27. The condenser unit condenses the hot gas received from the compressor, and the condensed refrigerant is then circulated to an evaporator 40 (shown in FIG. 4), where the refrigerant evaporates, cooling the adjacent surface of the water reservoir. From the evaporator, the refrigerant is returned to the compressor via a supply line.

In keeping with the invention, the frame structure 25 supports the refrigeration system 35, as described above, the cooling reservoir 100, a hot tank 220, the dispensing valve or valve waterway assembly 156, and the side, front, and top panel components 20, 22 and 23. The reservoir 100 is supported by and rests on the shelf 28, and will be described in greater detail hereinbelow with reference to FIG. 4. As will be understood from the exploded view in the lower right side of FIG. 2, the hot tank 220 is suspended from shelf 28 and has an inlet 222 and an outlet 224.

Figure 11:
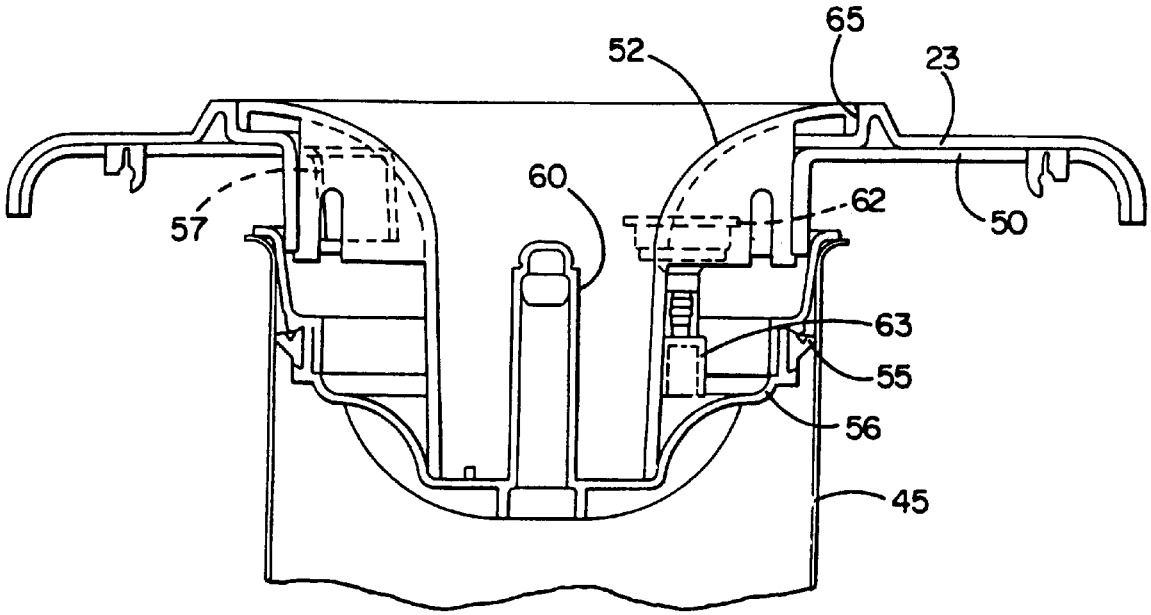
FIG. 11 is an enlarged cross-sectional fragmentary view of the upper portion of the reservoir with a no-spill adapter and entry portion installed.

A top support 50 overlies the reservoir 45 and has an opening which is coextensive with the open top of the reservoir. A hygienic liquid dispensing system may be utilized with the dispenser of the present invention, and as shown in FIGS. 2 and 11 comprises a downwardly and inwardly tapered entry portion 52 nested in a cup-shaped support structure 56. The support structure includes a pair of diametrically opposed mounting arms 57 which engage the top support 50 and suspend the cup structure therefrom. An annular diaphragm-gasket 55 surrounds the cup-shaped structure and sealingly closes the open upper portion of the reservoir. Centrally located in the cup structure is an upstanding, hollow feed tube 60, whose operation is described in greater detail in U.S. Pat. No. 5,222,531, assigned to Elkay Manufacturing Company of Oak Brook, Ill. An air filter may be provided with a filter element 62 having a filter medium removably fitted on the housing of the filter. A conduit 63 is connected to the filter housing and passes via a grommet through the cup-shaped structure so that air cannot enter the reservoir except by passing through the filter medium.

It is a preferred feature of the present invention, and as illustrated in FIG. 2, that the top support 50 is designed to be covered by a top panel 23 which, as illustrated in FIG. 2, has an annular mounting ring 65 which is provided with a ledge to support the tapered entry member 52 extending downwardly and inwardly from the annular ring on the upper portion of the top panel 23. The entry member 52 is formed with a lower end having a length greater than the neck of the bottle 18 so that substantially all of the weight of the inverted bottle is supported by the annular ring 65 on the presented surface of the top panel. As shown in the embodiment of the invention illustrated in FIG. 11, the upstanding hollow feed tube 60 is formed integrally with and as a one-piece unit with the cup-shaped structure 56 which has an inwardly stepped sidewall adjacent the annular gasket 55. Also, as shown in FIG. 11, a peripheral flange portion at the upper end of the cup-shaped structure is adapted to engage and be supported on a radially extending shoulder portion of the reservoir 45 adjacent its open upper end.

Pursuant to an important feature of the invention, elongated metal rods 70, preferably all of uniform length to be interchangeable, and each with a head portion 71 on one end, are provided to secure selected components of and within the cabinet to one another. As shown most clearly in FIG. 2, one rod 70*a* is provided to interconnect the top support 50 to the upstanding frame component 27. The frame component 27 has, on its upper end, a pair of aligned holes 72*a* through which rod 70*a* can be inserted; a second pair of aligned openings is formed in two pivot lugs (not shown) which depend from the underside of the top support 50 and are molded integrally therewith. The pivot lugs are dimensioned to loosely fit within notches 74 formed in the top of the frame component 27, so that when the top support is placed in position on the frame component, the rod 70*a* can pass through the aligned holes of the frame component and the pivot lugs of the top support, thereby capturing the top support and pivotally securing it to the frame component.

Figure 3:
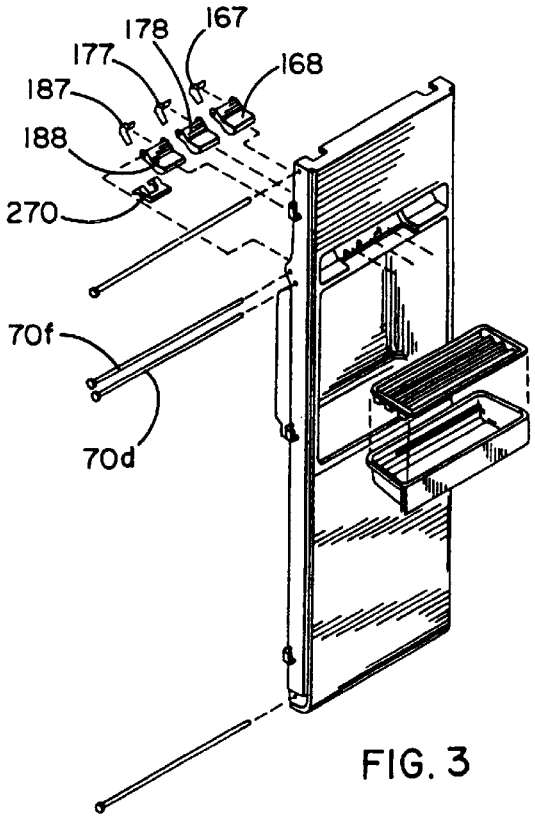
FIG. 3 is an exploded isometric view of the front panel of the dispenser of the present invention.

In keeping with another important aspect of the invention, the side panels 20 are also readily removable and are hung in position by lugs 76 provided on both the upstanding frame component 27 and the peripheral edge of the front panel 22 (as shown in FIG. 3). To facilitate the quick release of the side panels from the cabinet, a plurality of bayonet-type tab fittings 77 are provided on the inside surface of each side panel for engagement with recesses 78 formed in the complementary lugs 76 on the frame component 27 and the front panel 22. It will be understood, of course, that other suitable fastening means may be provided to allow the quick removal of the side panels from the frame assembly to provide ready access to the interior of the cabinet of the liquid dispensing system. Also as shown in FIG. 2, a single screw placed in recess 79 in frame component 27 can be utilized to lock projecting tab 79*a* on each side panel to the frame assembly so that only a standard tool, such as a screw driver, is necessary to remove the side panels from the cabinet. For further details concerning the preferred construction and arrangement of the readily removable side panels 20, front panel 22, top panel 23 and the cross pin connecting rods 70 reference may be made to the aforementioned application Ser. No. 08/139,469.

Figure 4:
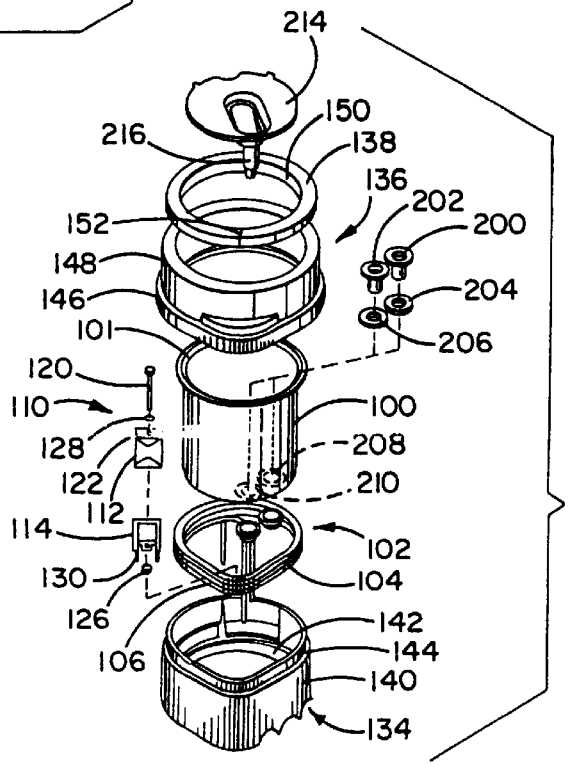
FIG. 4 is an exploded view of the primary reservoir and structure shown in assembled relation in FIG. 2.

The water or other potable liquid is received from the inverted water bottle by the removable cooling reservoir 100 through an open top 101, as shown in FIG. 1. Referring now to FIG. 4, in order to cool the water contained within the cooling reservoir 100, an evaporator coil assembly 102 is provided. The evaporator coil assembly 102 includes at least one refrigerant filled cooling coil or tube 104, and a bulbwell tube or cold thermostat 106. The cooling coil 104 and the bulbwell tube 106 are disposed about the lower portion of the reservoir 100, the cooling coil 104 preferably having several turns wrapped about the reservoir 100.

Figure 5:
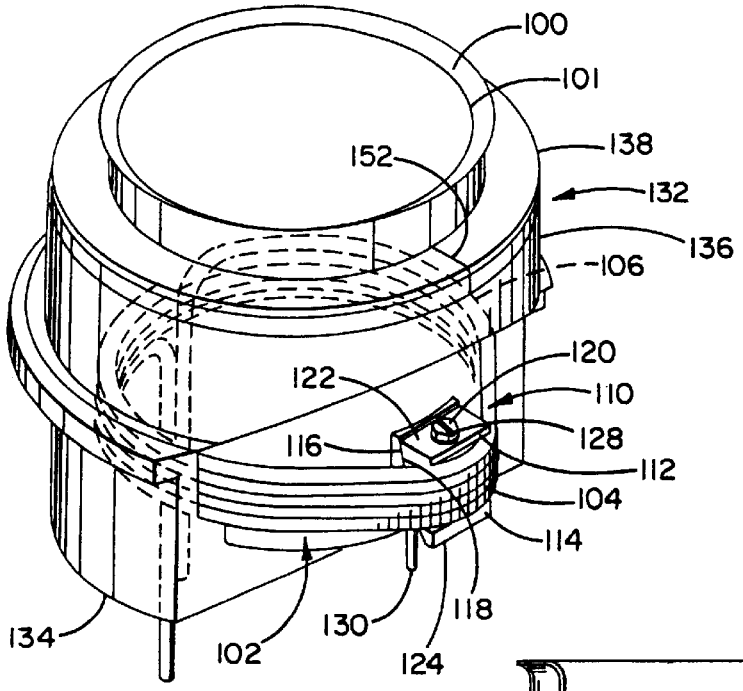
FIG. 5 is an enlarged isometric view of the cold water reservoir and insulation assembly, the insulation assembly being partially cut away to show the evaporator coil and wedge assemblies.

In accordance with an important aspect of the invention, the reservoir is removable from the water cooler 10. One feature of the invention which helps accomplish this object is the use of a camming block or expandable wedge assembly 110, which is shown in FIGS. 4 and 5. The wedge assembly 110 further increases efficiency of the cooler 10 by maximizing contact between the cooling coil 104 and the outer surface of the reservoir 100. The wedge assembly 110 includes upper and lower wedges 112, 114, having angled surfaces 116, 118 disposed adjacent one another. To adjust the relationship of the wedges 112, 114, a set screw or bolt 120 extends through the upper surface 122 of the upper wedge 112 and the lower surface 124 of the lower wedge 114, and into a nut 126. A washer 128 may be provided between the head of the bolt 120 and the upper surface 122 of the upper wedge 112. The nut 126 is secured to the lower wedge 114, preferably by countersinking the nut 126 into the lower surface 124, to prevent relative rotation between the nut 126 and the lower wedge 114. By adjusting the bolt 120 extending through the upper and lower wedges 112, 114, one may adjust the relationship of the wedges 112, 114 by sliding one over the other to increase or decrease the width of the wedge assembly 110.

As shown in FIG. 5, the wedge assembly 110 is disposed between the outer surface of the reservoir 100 and the inner circumference of the wrapped cooling coil 104. While the wedge assembly 110 may be coupled to the water cooler 10 by any appropriate means, the lower wedge 114 preferably includes teeth 130, in this case in the form of two probes, which extend downward into the insulation assembly 132. It will be appreciated that cooling coil 104, which is wrapped about the reservoir 100 and the wedge assembly 110, has a generally circular, but somewhat elliptical shape, with a limited non-circular portion. The wedge assembly 110 is disposed in the non-circular portion of the wrapped coil 104 having the smaller radius. By rotating the bolt 120 extending through the upper and lower wedges 112, 114, an operator may adjust the relationship between the wedges 112, 114 to increase or decrease the width of the wedge assembly 110. The bolt 120 may be tightened to increase the width of the wedge assemble 110 and draw the cooling coil 104 closer around the reservoir 100. Alternately, the bolt 120 may be loosened to decrease the width of the wedge assemble 110 to loosen the cooling coil 104 around the reservoir 110. By decreasing the width of the wedge assembly 110, the cooling coil 104 may be sufficiently loosened around the cooling reservoir 110 so that the reservoir may be lifted from its position within the wrapped cooling coil 104.

Another feature of the invention which contributes to the easy removal of the cooling reservoir 100 from the water cooler 10 is the insulation assembly 132, which may be at least partially disassembled. While the specific design of the insulation assembly 132 may vary, in this embodiment, the insulation assembly 132 includes three components, a lower base portion 134, an upstanding sidewall portion 136, and a top retainer ring 138. The insulation assembly 132 is preferably fabricated from styrofoam or the like.

The lower insulation base 134 has an elliptically shaped upwardly extending wall 140, with a closed bottom portion 142. The reservoir 100 and the coil assembly 102 nest within the lower insulation 134, as shown in FIG. 5.

The insulation sidewall portion 136 is disposed about the reservoir 100 adjacent the elliptically shaped upwardly extending wall 140 of the lower insulation 134. The sidewall insulation 136 has an elliptical shape at its lower portion which mates with the elliptically shaped wall 140 of the insulation base portion 134. In this embodiment, a flange 144 is disposed along the upper surface of the wall 140 of the lower insulation 134. The flange 144 mates with the insulation sidewall 136 to improve the integrity of the seal between the base and sidewall insulation 134, 136 and facilitates placement of the sidewall insulation 136 on the base insulation 134. The sidewall insulation 136 further includes a substantially cylindrical portion 148. In this way, the sidewall insulation 136 substantially follows the outer contours of the reservoir 100 and the evaporator coil assembly 102.

In order to seal the insulation assembly 132 to the outer surface of the reservoir 100, a top retainer ring 138 may be provided. The retainer ring 138 is disposed adjacent the top portion of the cooling reservoir 100. The insulation retainer ring 138 may likewise include a flange 150 which extends into the inner diameter of the insulation sidewall 136. This flange 150 properly locates the retainer ring 138 along the upper edge of the insulation sidewall 136 and seals the insulation assembly 132 to the outer surface of the reservoir 100.

According to an important aspect of the invention, the insulation sidewall 136 and top retainer ring 138 may be removed from the reservoir 100, so that the reservoir 100 may be lifted from the lower insulation base 134. In accomplishing this object, the retainer ring 138 has a split construction, so that it may be expanded and removed from the reservoir 100. In the preferred embodiment, the retainer ring 138 has only one split 152. It will be appreciated, however, that the retainer ring 138 could include a hinge-type arrangement, or be designed to include two or more components. To remove the reservoir 100 from the insulation assembly 132, the retainer ring 138 is first removed. The insulation sidewall 136 may then be lifted off of the cooling reservoir 100, and the cooling reservoir 100 lifted from the insulation base 134.

In order to direct the flow of the water through the water cooler 10, a valve waterway assembly 156 is disposed substantially adjacent the reservoir 100. The valve waterway assembly 156 is preferably fabricated from a durable polymer. Shown most clearly in FIGS. 2 and 6, the assembly 156 includes a series of internal flow paths 160, 170, 180, which communicate with inlets 162, 172, 182 and standard spring biased valves 164, 174, 184 to dispense cooled, ambient temperature, and heated water from the outlets 166, 176, 186. The valves 164, 174, 184 are actuated by depressing spring biased valve operating levers or dispensing levers 168, 178, 188 (the springs are identified as 167, 177, 187 in FIG. 3).

Figure 6:
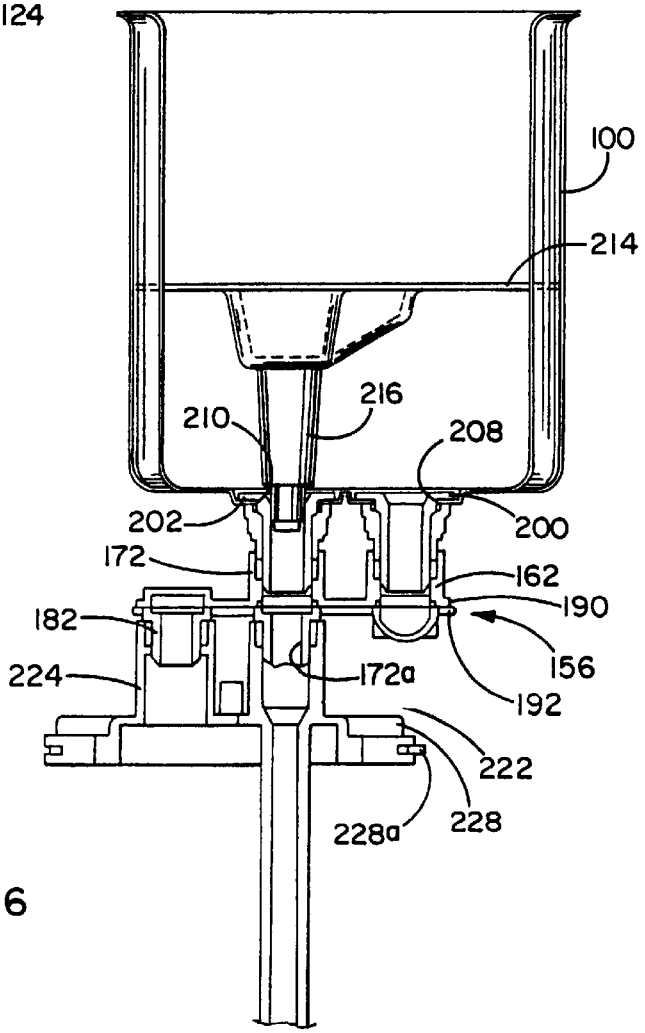
FIG. 6 is an enlarged cross-sectional view of the cooling reservoir, valve waterway assembly, and hot tank cover.
Figure 7:
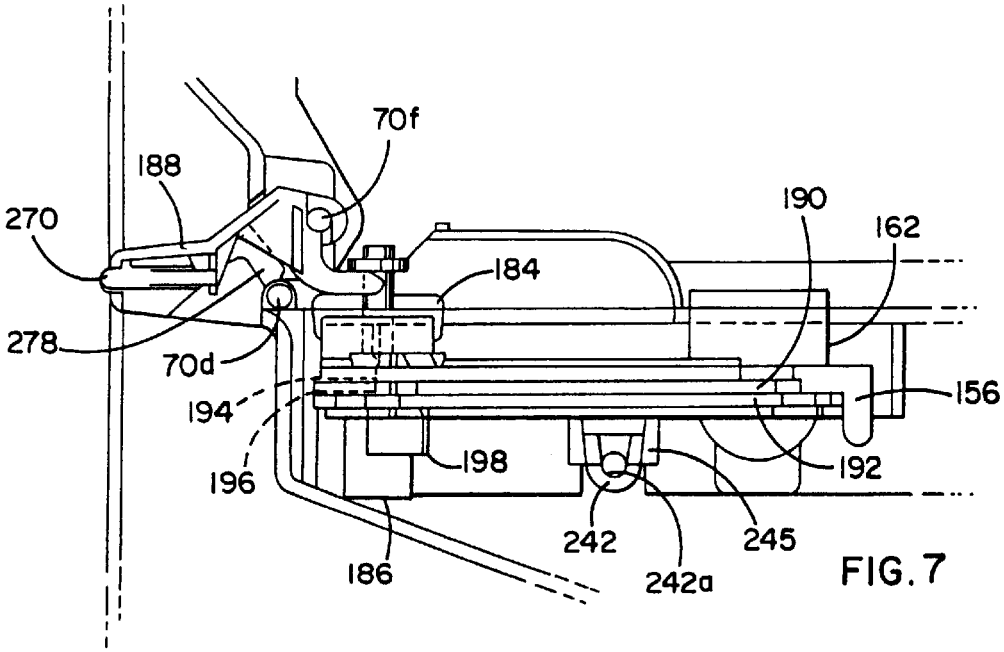
FIG. 7 is an enlarged side view of the valve waterway assembly and the hot water dispensing lever.

In accordance with an important object of the invention, the valve waterway assembly 156 is completely removable from the water cooler 10, and may be disassembled for internal cleaning. In accomplishing this object, and as shown in FIGS. 6 and 7, the valved waterway assembly 156 illustrated there includes upper and lower components 190, 192, which are hinged together along one edge in a clamshell design. In this embodiment of the invention, the upper and lower components 190, 192 are hinged together by hooks and eyes and the upper and lower components 190, 192 may be completely separated. Thus, the internal flow paths 160, 170, 180, inlets 162, 172, 182, valves 164, 174, 184, and outlets 166, 176, 186 of the assembly may be thoroughly cleaned. It will be appreciated, however, that the hinge may be of any appropriate design. For example, the waterway assembly 156 may be formed as a unitary assembly, and include a "living hinge," formed at a weakened area of reduced thickness between the upper and lower components 190, 192.

In the embodiment illustrated in FIGS. 6 and 7, to secure the upper and lower components 190, 192 of the valve waterway assembly 156 together, the assembly 156 is provided with a key fastening arrangement, as shown in FIG. 7. The upper and lower components 190, 192 include openings 194, 196 through which removable fastening keys 198 may be inserted and rotated to secure the components 190, 192 together along their open edge which defines the parting line between these components.

Returning now to the design of the reservoir 100, as shown in FIGS. 4 and 6, the water passes out of the reservoir 100 and into the valve waterway assembly 156. The water flows through discharge fittings or inlet waterway tubes 200, 202 sealed by gaskets 204, 206 in openings 208, 210 in the bottom portion of the reservoir 100. The inlets 162, 172 are sealed to the inlet waterway tubes 200, 202 with O-rings or the like, and, preferably, provide a tight engagement to secure the components together.

Cooled water from the lower portion of the reservoir 100 passes directly out through the waterway tube 200 and into the waterway assembly 156 through the inlet 162 and the internal flow path 160. The cooled water may then be dispensed through the outlet 166 on demand by depressing the cold water dispensing lever 168 to actuate the valve 164.

The water within the reservoir 100 is divided by a removable baffle 214, which may be removed from the reservoir 100 for cleaning, repair, or replacement. In this way, the cooled water is disposed below the baffle 214 in the lower portion of the reservoir 100, while the higher, ambient temperature water, or cooking water, is disposed above the baffle 214 in the upper portion of the reservoir 100. The baffle 214 includes a funnel shaped structure 216, which is disposed within the other opening 210, such that cooking water flows out of the upper portion of the reservoir 100 through the waterway tube 202. To prevent the baffle 214 from being inadvertently placed in the opening 208 through which cooled water is designed to flow, the baffle 214 is keyed to the cooking inlet waterway tube 202.

Cooking water flows from reservoir 100, through the inlet waterway tube 202, and into the inlet 172 and internal flow path 170 of the valve waterway 156. The cooking water may then be dispensed through the outlet 176 on demand by depressing the cook water dispensing lever 178 to actuate the valve 174.

In order to provide hot water from the water cooler 10, a hot tank 220 may be provided. A flow of water is provided to the hot tank 220 from the cooking water in the reservoir 100 through the inlet 172 of the valve waterway assembly 156. As best shown in FIG. 6, the inlet 172 provides a flow of cooking water to a hot tank inlet tube 222 through opening 172*a* in the valve waterway assembly 156. In this way, the inlet 172 not only provides cooking water to the internal flow path of the valve waterway assembly 156 for dispensing, the inlet 172 further provides room temperature cooking water from the reservoir 100 to the hot tank 220 for further heating.

To provide hot water from the hot tank 220, a hot tank outlet tube 224 is provided. The hot tank outlet tube 224 communicates with and is sealed to the inlet 182. Preferably, the tube 224 and the inlet 182 are tightly engaged to secure the components together. In this way, the hot tank 220 provides a flow of heated water to the internal flow path 180 for dispensing through the outlet 186 upon depressing the hot water dispensing lever 188 to actuate the valve 184.

Referring now to FIG. 3, rod 70*f* secures the levers 168, 178, 188 in the front panel of the cooler 10. In order to dispense cold or cook water from the valves 164, 174, the cold or cook water dispensing lever 168, 178 is depressed to rotate the lever counterclockwise about pivot rod 70*f*. As the dispensing lever 168, 178 rotates, the actuator arm 274 of the dispensing lever lifts the stem 164*a*, 174*a* of the valve 164, 174 to open the valve 164, 174 to permit a flow of water through the outlet 166, 176.

Turning now to FIG. 7, the hot water dispensing lever 188 operates in substantially this same manner to dispense water through the outlet 186. In order to prevent accidental dispensing of hot water, however, and in order to comply with federal safety standards, the hot water dispensing lever 188 is provided with a safety lock, which includes a push bar or safety button 270 which fits within and must be pressed inward within the lever 188 in order to operate the dispensing lever 188.

When the safety button 270 is in the position shown in FIG. 7, the safety arm 278 abuts a stationary safety rod 70*d*. Thus, the interaction of the safety arm 278 and the safety rod 70*d* prevents the dispensing lever 188 from rotating about the pivot rod 70*f*. As a result, the hot water dispensing lever 188 cannot be depressed to actuate the valve 184 to provide a flow of water.

In order to operate the hot water dispensing lever 188, the safety button 270 must first be pressed inward within the dispensing lever 188. When the safety button 270 is depressed inward, the safety arm 278 clears the safety rod 70*d* to permit rotation of the dispensing lever 188 about the pivot rod 70*f*. Thus, it is only when the safety button 276 is depressed that the valve 184 may be actuated to dispense hot water from the outlet 186.

Figure 10A:
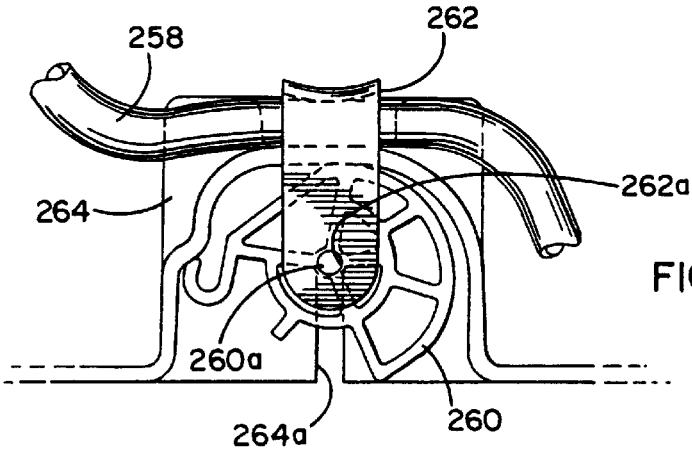
FIG. 10*a* is an enlarged side view of the pinching assembly wherein the discharge hose is pinched.
Figure 9:
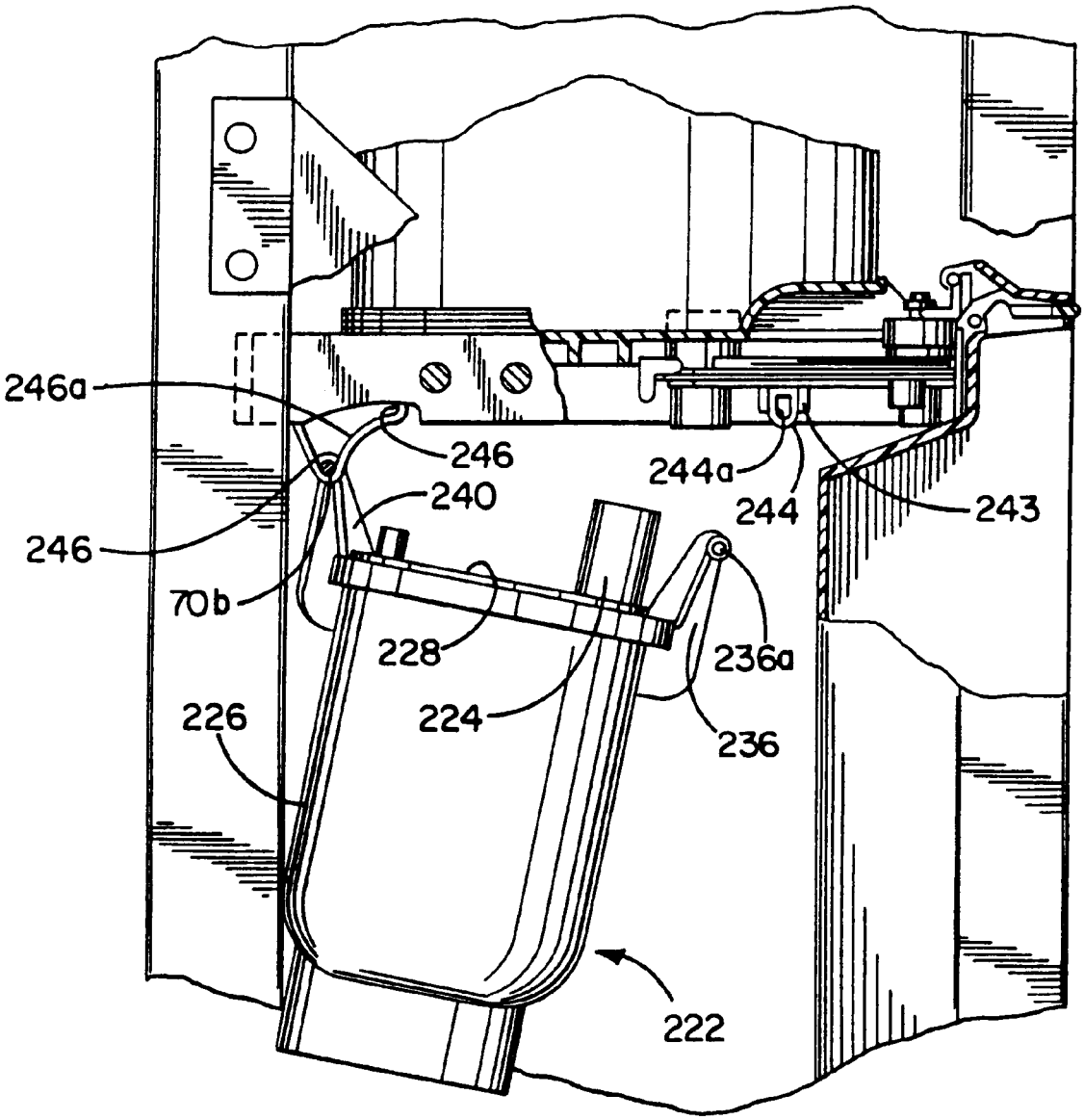
FIG. 9 is an enlarged side view of the hot tank partially disassembled from the cooler.

Returning now to the structure of the hot tank 220 and in accordance with the objects of the invention, the hot tank 220 is completely removable from the water cooler 10, and may be disassembled for cleaning or replacement. As shown in FIGS. 2, 9 and 10, the hot tank 220 includes an open top tank 226, and a cover 228, each having a series of flanges 226*a*, 228*a*, which engage along their mating surfaces. In this way, the open top tank 226 and cover 228 may be separated to facilitate easy and thorough cleaning.

Preferably, the hot tank inlet and outlet tubes 222, 224 extend through and are formed integrally with the cover 228. However, the tubes could be separately formed and secured and sealed to the cover 228. The heating coil 230 and the heat thermostat 232 are preferably located in the lower portion of the hot tank 220, and the hot tank inlet tube 222 extends down to the bottom portion of the hot tank 220. In this way the lower temperature water is heated, and then rises to the top. The hot tank outlet tube 224 extends from the upper portion of the hot tank cover 228, to drain the hottest water from the hot tank 220.

Figure 8:
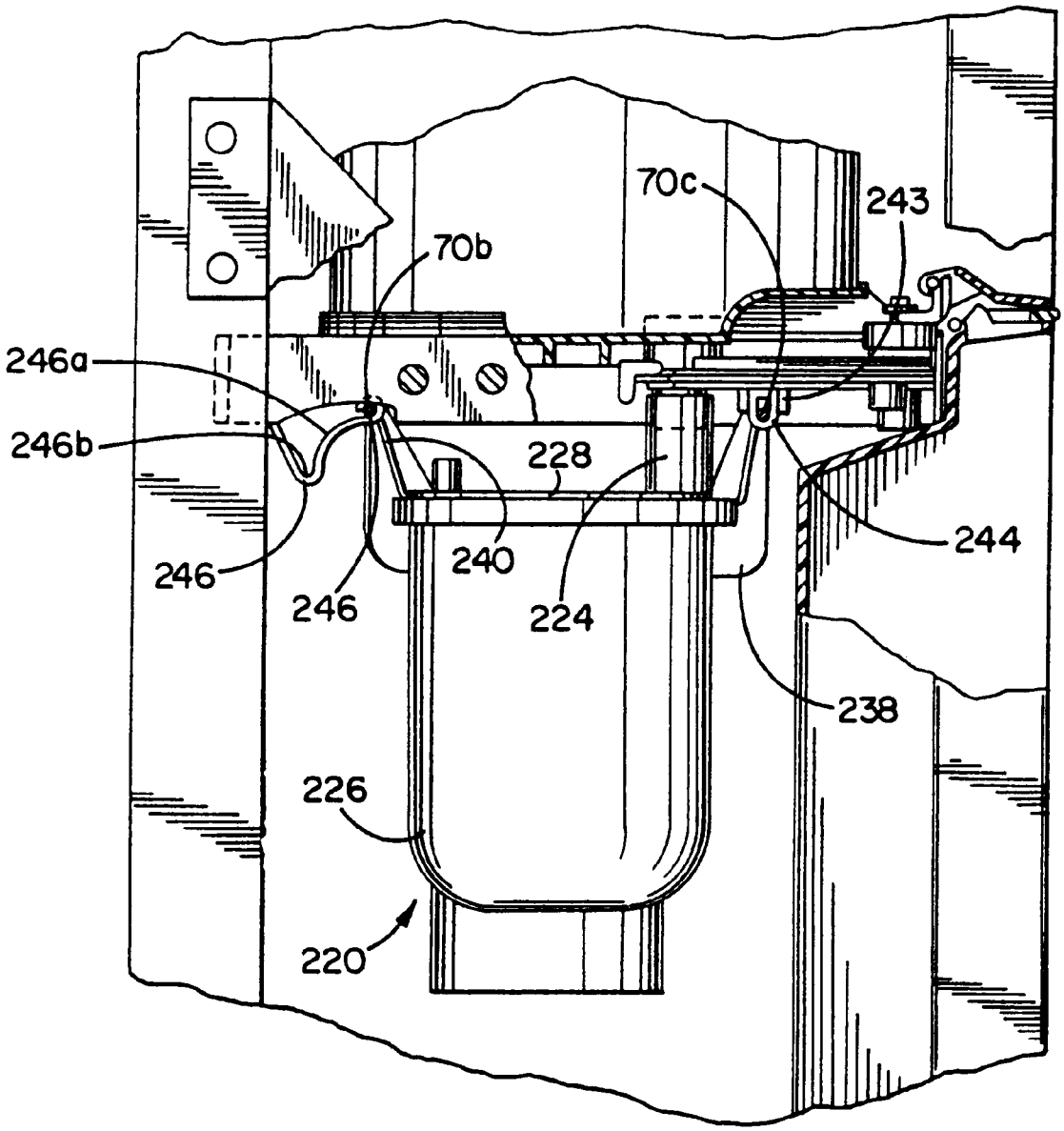
FIG. 8 is an enlarged side view of the hot tank in the use position in the cooler.

As shown in FIG. 8, the hot tank 220 is held in position in the water cooler 10 by two rods 70*b*, 70*c*, which provide hinge type assemblies that may be disassembled to permit removal of the hot tank 220. Disposed along the open top of the tank 226 are spaced ears or arms 234, 236, 238, 240 which define through holes 234*a*, 236*a*, 238*a*, 240*a*. In the preferred embodiment of the invention, the arms are each formed from a pair of arm components which are curved in opposite directions to form the through holes.

The shelf 28 of the water cooler 10 is similarly provided with lugs or support brackets 242, 244, 246, and spacers 243, 245 which extend downward from the lower surface of the shelf 28. Support brackets 242, 244 define through holes 242*a*, 244*a*. Support bracket 246 defines a "slotted" opening 246*a* having two seats 246*b*, 246*c*. The hinge assemblies further include two rods 70*c*, 70*b* which extend through the through holes 234*a*, 236*a*, 238*a*, 240*a*, 242*a*, 244*a*, and slotted opening 246*a* to suspend the hot tank 220 within the water cooler 10. It will be noted that the spacers 243, 245 are disposed adjacent the rod 70*c* to stabilize the rod 70*c* and the hot tank 220 in position.

As shown in FIG. 8, when the hot tank 220 is in operational position within the water cooler 10, rod 70*c* is disposed within through holes 234*a*, 236*a*, 242*a*, 244*a*; rod 70*b* is disposed within through holes 238*a*, 240*a* and opening 246*a*, seated at seat 246*b*. In order to remove the hot tank 220 from the water cooler 10, rod 70*c* is removed from the through holes 234*a*, 236*a*, 242*a*, 244*a*. Once rod 70*c* is removed, rod 70*b* is free to move downward in the slotted opening 246*a* to seat 246*b* to pivot and move the hot tank 220 downward within the water cooler 10 away from the valve waterway assembly 156. Rod 70*b* may then be removed from through holes 238*a*, 240*a* and opening 246*a* to completely remove the hot tank 220 from the water cooler 10. The hot tank 220 may be reassembled within the cooler 10 in a similar manner.

In order to prevent injury from hot fluid while removing the hot tank 220, the hot tank 220 is provided with a drain hole 256 to which a flexible plastic line or drain hose 258 is coupled. In this way, the hot tank 220 may be drained of all hot fluid before attempting disassembly.

To prevent fluid from draining from the hose 258 and hot tank 220 during normal usage of the water cooler 10, a pinching assembly is provide to compress or pinch shut the hose 258. The assembly includes a cam 260, a U-shaped stirrup 262, and a seat 264. The seat 264, which may be in the form of a recess, may be integrally molded with the frame component 27 of the water cooler 10. Alternately, the seat 264 may be formed as a separate component and then secured to the frame 27.

Figure 10B:
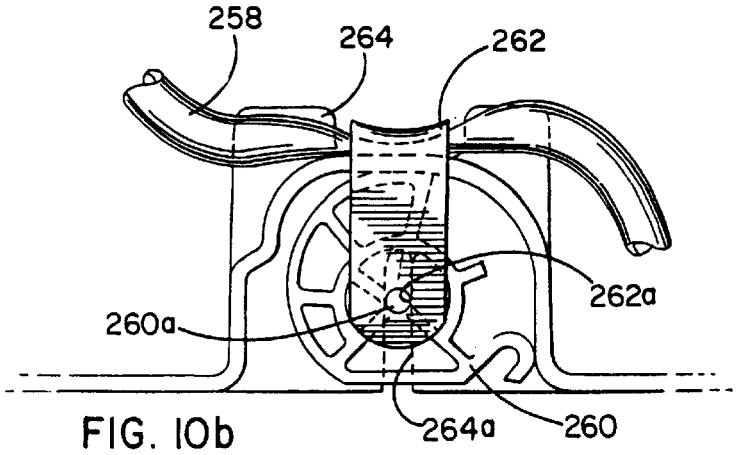
FIG. 10*b* is an enlarged side view of the pinching assembly wherein the discharge hose is not pinched.

The cam 260 is disposed substantially within the seat 264, as shown in FIG. 10*b*. The rotational axis of the cam 260 is defined by outwardly extending pins 260*a*, 260*b*. The pins 260*a*, 260*b* extend through slotted openings 264*a*, 264*b* in the seat 264 and into openings 262*a*, 262*b* in the stirrup 262. Rotation of the cam 260 draws the stirrup 262 closer to the seat 264. The hose 258 is disposed between the seat 264 and the stirrup 262. In order to operate the pinching assembly, the cam 260 is rotated to draw the stirrup 262 to the seat 264 and pinch the hose 258 therebetween. To permit water to drain through the hose 258, the cam 260 is again rotated to release the pinching pressure on the hose 258. It will be appreciated that the cam 260 is disposed along the back of the cooler 10 and is completely recessed in the seat so that it requires the insertion of a thin tool, such as a screw driver, to initiate its opening rotation. Thus, it is a safety feature that the cam cannot be rotated in the opening direction by a child's finger, which could result in the child being scalded by hot water discharged from the drain hose.

Figure 12:
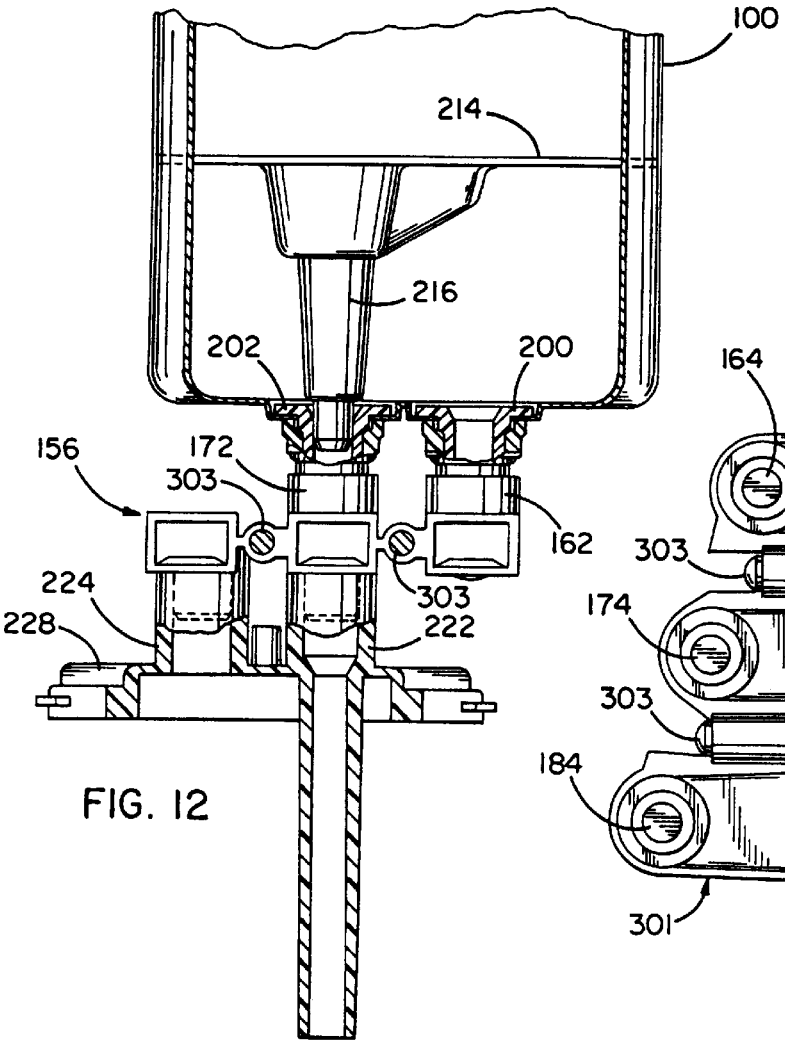
FIG. 12 is an enlarged cross-sectional view, similar to FIG. 6, of the cooling reservoir, a modified preferred waterway and valve assembly, and hot tank cover.
Figure 14:
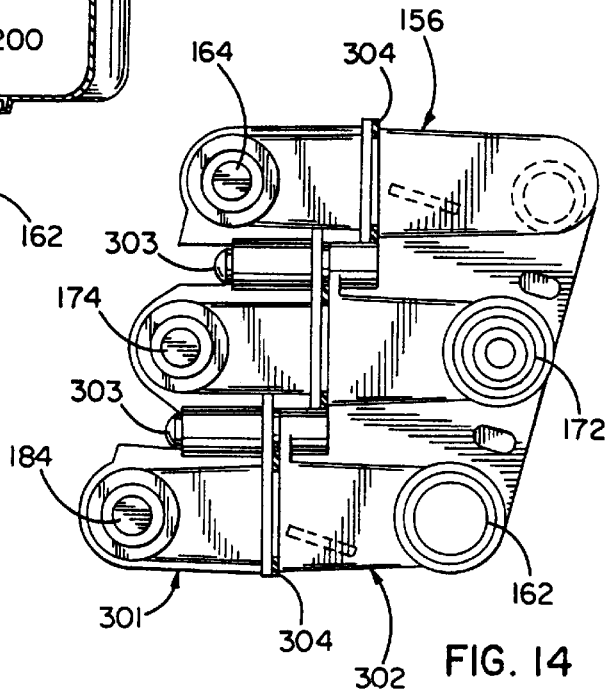
FIG. 14 is an enlarged top plan view of the modified preferred waterway and valve assembly shown in FIGS. 12 and 13.
Figure 13:
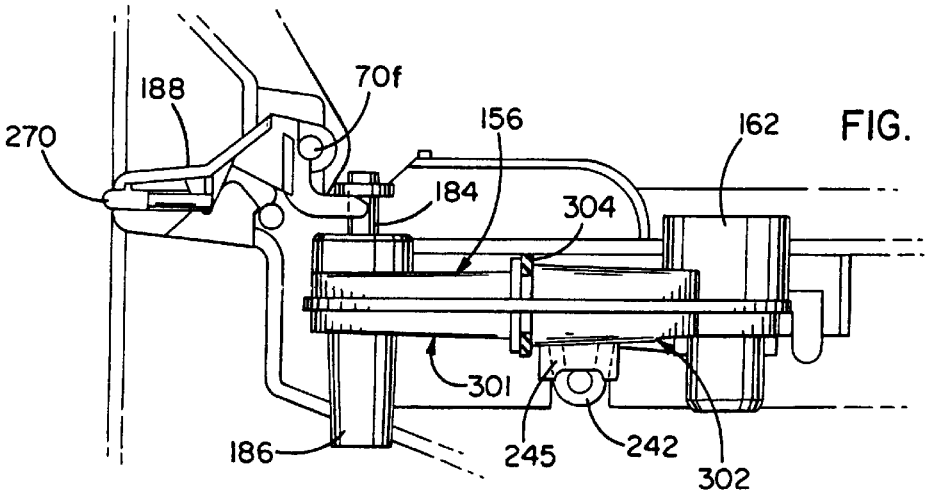
FIG. 13 is an enlarged side view similar to FIG. 7, of the modified preferred waterway and valve assembly and hot water dispensing lever shown in FIG. 12.

Referring now to FIGS. 12–14, an alternative and preferred embodiment of the waterway and valve assembly 156 is shown. In this preferred embodiment, the valve assembly is of two-piece construction comprised of front 301 and rear 302 waterway portions which are joined together by suitable fastening means such as screws 303, bolts or the like. To insure that the assembly does not leak along the parting line between the two halves 301, 302 of the assembly, suitable seals 304 are sandwiched between the front and rear waterway portions 301, 302 before the screws 303 are tightened. It has been found that this front and rear two-piece construction of the waterway and valve assembly 156 is easily openable for inspection and cleaning and can be even more easily closed and reliably resealed then the upper and lower two-piece embodiment illustrated in FIGS. 6 and 7. In other respects, both embodiments of the waterway and valve assembly 156 illustrated in FIGS. 6 and 7 and 12–14 are similar and the same reference numbers have been used to designate the common parts and features.

In FIG. 12 it will be seen that the reservoir 100 is provided with a cold water outlet fitting 200 and a cook water outlet fitting 202 which are respectively press-fit into the inlet coupling portions 162 and 172 in the valve and waterway assembly 156. The reservoir 100 is provided with a baffle 214 having an outlet funnel portion 216 which directs the relatively warmer cooking water into the outlet fitting 202. As in the prior embodiment, this cooking water is directed down into the assembly 156, through an internal waterway and out through a coupling portion 172*a* into an inlet tube 222 of the hot tank 226.

Hot water from the hot tank 226 passes up through an outlet tube 224 into an inlet coupling portion 182 of the valve and waterway assembly 156. To dispense hot water through the outlet 186, the hot water dispensing lever 188 is operated to open valve 184 in the same manner as previously described. Similarly, in order to dispense cold or cook water from the valves 164, 174 the respective cold or cook water dispensing lever 168, 178 is depressed in the same manner as previously described.

It is to be understood that any allowed claims based on this application are to be accorded a range of equivalence commensurate in scope with the advance over the prior art.

We claim as our invention:

1. A liquid dispensing device including a generally cylindrical liquid reservoir normally open at its upper end for receiving liquid from an inverted bottle having a downwardly and inwardly sloping shoulder portion merging into a depending neck portion defining a discharge opening, said liquid dispensing device including valve means for dispensing liquid from the reservoir, and said liquid dispensing device comprising, in combination, a top support having a generally centrally disposed annular opening with a depending skirt portion dimensioned for reception the open upper end of said reservoir, said top support defining a generally annular ring portion for supporting said shoulder portion of said inverted bottle above said liquid reservoir and wherein said top support includes a downwardly extending peripheral margin for generally centering said annular opening over said reservoir, a feed tube defining a flow path for dispensing liquid from said inverted bottle into said reservoir and for admitting replacement air from said reservoir into said bottle, means for mounting said feed tube in upstanding relation in the upper portion of said reservoir, said mounting means including a tapered entry portion disposed generally downwardly and inwardly from said top support for receiving and guiding said neck of said inverted bottle, said mounting means also including a cup-shaped structure formed integrally with and supporting said upstanding feed tube in generally centered relation with respect to said annular opening and said reservoir, said cup-shaped structure having an inwardly stepped sidewall and including a peripheral flange portion engageable with and supported by said open upper end of said reservoir, and sealing means including an annular gasket carried by and surrounding said cup-shaped structure adjacent said stepped sidewall below said peripheral flange portion for sealingly closing said open upper end of said reservoir.

2. A liquid dispensing device as defined in claim 1 wherein said peripheral flange portion of said cup-shaped structure is provided at its upper end with at least a pair of circumferentially spaced members for supporting and suspending said cup-shaped structure within the upper end of said reservoir.

3. A hygienic liquid dispensing adapter for use with a liquid dispensing device including a generally cylindrical liquid reservoir normally open at its upper end for receiving liquid from an inverted bottle having a downwardly and inwardly sloping shoulder portion merging into a depending neck portion defining a discharge opening, said liquid dispensing device including a generally annular ring portion for supporting said shoulder portion of said inverted bottle above said liquid reservoir, said adapter comprising, in combination, a feed tube defining a flow path for dispensing liquid from said inverted bottle into said reservoir and for admitting replacement air from said reservoir into said bottle, means for mounting said feed tube in upstanding relation in the upper portion of said reservoir, said mounting means including a cup-shaped structure formed integrally with and supporting said upstanding feed tube in generally centered relation with respect to said annular ring portion and said reservoir, said cup-shaped structure having an inwardly stepped sidewall and including a peripheral flange portion adapted to be supported by said open upper end of said reservoir, and sealing means including an annular gasket carried by and surrounding said cup-shaped structure adjacent said stepped sidewall below said peripheral flange portion for sealingly closing said open upper end of said reservoir.

4. A hygienic liquid dispensing adapter as defined in claim 3 wherein said peripheral flange portion of said cup-shaped structure is provided at its upper end with at least a pair of circumferentially spaced members for supporting and suspending said cup-shaped structure within the upper end of said reservoir.

5. A hygienic liquid dispensing adapter as defined in claim 4 wherein said mounting means also includes a tapered entry portion disposed generally downwardly and inwardly into said cup-shaped structure for receiving and guiding said neck of said inverted bottle into coaxial alignment with said upstanding feed tube.

6. In a hygienic liquid dispensing adapter for use with a liquid dispensing device including a generally cylindrical liquid reservoir normally open at its upper end for receiving liquid from an inverted bottle having a downwardly and inwardly sloping shoulder portion merging into a depending neck portion defining a discharge opening, said liquid dispensing device including a generally annular ring portion for supporting said shoulder portion of said inverted bottle above said liquid reservoir, wherein said adapter includes a feed tube defining a flow path for dispensing liquid from said inverted bottle into said reservoir and for admitting replacement air from said reservoir into said bottle, and means for mounting said feed tube in upstanding relation in the upper portion of said reservoir, the improvement comprising said mounting means including a cup-shaped structure formed integrally with and supporting said upstanding feed tube in generally centered relation with respect to said annular ring portion and said reservoir, said cup-shaped structure having an inwardly stepped sidewall and being provided at its upper end with at least a pair of circumferentially spaced members for supporting and suspending said cup-shaped structure within said open upper end of said reservoir, and sealing means including an annular gasket carried by and surrounding said cup-shaped structure adjacent said stepped sidewall below said circumferentially spaced members for sealingly closing said open upper end of said reservoir.

* * * * *